US005154688A

United States Patent [19]

Boyd

[11] Patent Number: 5,154,688

[45] Date of Patent: Oct. 13, 1992

[54] DECURLING BAR COVER

[76] Inventor: Brent A. Boyd, Rte. 5, Box 66-B, Tylertown, Miss. 39667

[21] Appl. No.: 756,292

[22] Filed: Sep. 6, 1991

[51] Int. Cl.[5] ..... B65H 23/34

[52] U.S. Cl. ..... 493/459; 493/468; 162/271; 226/195; 226/196

[58] Field of Search ..... 493/302, 439, 459, 468; 162/270, 271; 226/195, 196, 197; 407/119

[56] References Cited

U.S. PATENT DOCUMENTS

| | | | |
|---|---|---|---|
| 1,114,468 | 6/1913 | Grahl . | |
| 2,339,070 | 1/1944 | Hayes | 93/61 |
| 2,730,357 | 1/1956 | Deichmann | 493/439 |
| 2,737,089 | 3/1956 | Baumgartner | 162/271 |
| 3,521,802 | 7/1970 | Bossons | 226/196 |
| 3,649,447 | 3/1972 | Turner | 162/271 |
| 3,962,957 | 6/1976 | Hinzmann | 93/1 |
| 3,962,958 | 6/1976 | Hobart | 493/302 |
| 3,971,696 | 6/1976 | Manfredi | 162/271 |
| 4,035,878 | 7/1977 | Cheatham | 162/271 |
| 4,360,356 | 11/1982 | Hall | 493/459 |
| 4,697,728 | 10/1987 | Sawyer et al. | 162/271 |
| 4,788,846 | 12/1988 | Morita | 72/160 |

FOREIGN PATENT DOCUMENTS

| | | | |
|---|---|---|---|
| 3833804 | 6/1989 | Fed. Rep. of Germany | 162/271 |

*Primary Examiner*—William E. Terrell
*Attorney, Agent, or Firm*—David L. Ray

[57] ABSTRACT

Curl removing bars are employed in prior art paper processing such as paper coating to remove the curl from paper stored on a supply or storage roll. The curl removing bar is usually aligned parallel to the axis of rotation of the supply or storage roll. The curl removing bar is subject to wear due to the friction of the paper sliding over the bar. The invention provides a curl removing bar assembly including a ceramic cover which rests upon or is fastened to a curl removing bar for preventing frictional wear of the curl removing bar. The ceramic cover contacts the sheet material to remove the curl.

11 Claims, 3 Drawing Sheets

DECURLING BAR COVER

BACKGROUND OF THE INVENTION

1. Field of the Invention

The invention relates to the paper making process, and in particular, to removing the curl from a strip of sheet material wound upon a roll. In particular, the present invention relates to devices for removing the curl from paper being removed from a storage or supply roll for cutting into flat sheets.

2. Description of the Related Art

It is well known in the art that sheet material, such as a web or sheet of paper, paperboard, or paper laminates, develops a curvature or curl when wound upon a storage roll at the end of the manufacturing process. When a storage roll is removed from storage to supply paper for further processing, the storage roll then becomes the supply roll. As paper is drawn from the storage roll in a continuous sheet to be cut into individual sheets or made into other products, the curl must be removed from the paper as it is removed from the supply roll.

Many devices are known in the art for removing curl from paper. Some devices include a metal bar aligned parallel to the axis of rotation of the supply roll over which the paper sheet is pulled at an angle to the direction from which the paper sheet is pulled from the supply roll. Such bars are referred to in the art as "curl bars".

Exemplary of the many devices for removing curl from sheet material on a storage or supply roll are the following U.S. Patents:

U.S. Pat. No. 4,788,846 discloses a process for the correction of curls of flexible metal clad laminate and for the improvement of its dimensional stability, the laminate having a thin aromatic polyimide film formed on a long metal foil, the laminate being caused to slide under tension, along its length, on curved surfaces of four bars arranged at specific positions, so that its curls are corrected and its dimensional stability is improved. In column 11, lines 3 through 11, the material of the bars is disclosed as being high-rigidity material such as glass, ceramic, metal or synthetic resin, most preferably, a strong ceramic such as zirconia ceramic, and their cross-sections (namely, cross-sections perendicular to the lengths of the bars) may be of any desired shape such as a rectangle, square or circle having a curve portion as shown in FIG. 7 or FIG. 8.

U.S. Pat. No. 4,360,356 discloses a decurler apparatus for removing curl from a continuous moving web. The apparatus includes cylindrical members between which the web travels. The engagement members are pivotally movable so that either surface of the web can be engaged by one of the engagement members with any desired degree of pressure for removing the curl in the continuous web during travel thereof. If the curl is upwardly, the engagement members are pivoted to engage the opposite surface of the web. The degree of pressure applied for decurl action can be adjusted by adjusting the angle of the engagement members with respect to the line of travel of the continuous web. The apparatus also includes brush members engageable with the web to control the tensional forces upon the web as the web engages one or both of the engagement members.

U.S. Pat. No. 3,971,696 discloses a paper web decurling apparatus including a freely rotatable relatively large diameter support roll and a freely rotatable small diameter decurling roller disposed parallel to the support roll for pressure engagement with a paper web thereon. Selectively operable devices are provided for adjustably varying the pressure of the decurling roller against the paper web and support roll and selectively operable devices are provided to rotationally position the decurling roller to engage the paper web on the support roll at any desired location circumferentially of the support roll.

U.S. Pat. No. 3,962,957 discloses a curling device for webs of paper or the like which are used for the making of adhesive-coated uniting bands in filter cigarette making machines including a curling bar having a sharp edge which extends transversely of and flexes the running web to eliminate localized stresses in the material of the web and/or to equalize the length of lengthwise extending portions of the web. The bar is pivotable or otherwise movable in its support (e.g., it can be mounted for pivotal movement about an axis which is normal to the edge) so that the bar can change its angular position in reponse to unequal distribution of web pressure lengthwise of the edge. Such mounting of the bar reduces the likelihood of breaking the web when the length of the one and/or other marginal portion of the web exceeds the length of the median portion. In Column 9, lines 4–7, the curling device is disclosed as preferably consisting of steel or another suitable metallic material; however, certain types of synthetic plastic materials can be used instead of or as coatings for metallic curling devices.

U.S. Pat. No. 3,649,447 discloses an apparatus for decurling a paper web as it is being fed from its supply roll including a frame having a pivotable decurl member mounted on a pivotable linkage and positioned in a web path and a rubber-covered roll operatively connected to the linkage and engaging the supply roll surface such that the angle the decurl member makes with the web path is caused to change to vary the degree of decurl in response to the changes in the roll diameter. The decurl member comprises a generally circular member subtended by a chordal portion forming a decurling edge thereon.

U.S. Pat. No. 2,737,089 discloses an apparatus for decurling a web after leaving its supply roll and prior to other operations thereon, the combination of two spaced sets of feed rolls, continuously engaging the web, a decurling member disposed between the sets of rolls against which the web is fed as it passes from one set of rolls to the other, positively and continuously acting drive device for each set of rolls, the set of rolls beyond the decurling member acting to feed the web at a higher speed than that of the other set of rolls to produce a tension in the web as it passes over the decurling member, a device for continuously exerting a positive nipping pressure on the web between the rolls of each set, a device for varying the nipping pressure between one set of rolls as compared to the other to vary the effective tension of the web as it is carried over the decurling member, other feed rolls spaced from the sets of feed rolls and operating at a speed permitting the formation of a free loop in the web between the other feed rolls and the spaced sets of feed rolls, and a device controlled by the loop for reducing the speed of the spaced sets of feed rolls relative to the other feed rolls to limit the size of the loop in the web.

U.S. Pat. No. 2,339,070 discloses a sheet decurling apparatus and a guide member engaging opposite sides of a traveling sheet, arranged to bend the sheet across the decurling member, and an adjusting construction for varying the spacing of the decurling member and the guide member in the direction of sheet travel.

U.S. Pat. No. 1,114,468 discloses a method for treating paper for spiral mouthpieces of cigarettes which is a process for rendering elastic the paper out of which the spiral mouthpieces for cigarettes are made, including drawing the entire paper strips under continuous tension over a sharp edge, the entire paper strips being bent while being drawn over the sharp edge.

SUMMARY OF THE INVENTION

In accordance with the present invention there is provided a curl removing bar assembly including a ceramic cover which rests upon or is fastened to a curl removing bar for preventing frictional wear of the curl removing bar.

The present invention has the advantage of preventing wear of a curl removing bar and reducing the time a paper making process must be stopped to change worn curl bars.

In addition, the present invention is low in cost and easy to manufacture.

Furthermore, the curl removing bar assembly of the invention may be quickly and easily placed on a curl bar, and worn curl bar covers of the invention may be quickly and easily replaced.

BRIEF DESCRIPTION OF THE PREFERRED EMBODIMENTS

Figure 1:
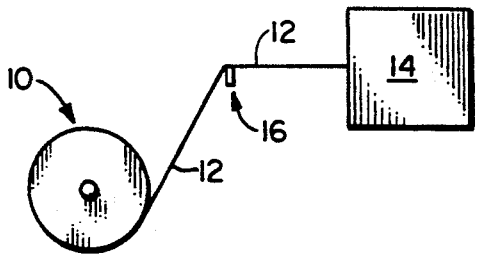
FIG 1. PRIOR ART
FIG. 1 is a schematic view of a paper making process of the prior art showing an end view of a curl bar.

Referring now to the drawings, in FIG. 1 is shown a paper supply roll generally indicated by the numeral 10 which has a continuous paper sheet or web 12 wrapped therearound. Sheet 12 is being drawn from supply roll 10 to a sheet processing station 14 such as that shown in FIG. 1 of U.S. Pat. No. 3,962,957, which is hereby incorporated by reference. At processing station 14, the paper sheet or web 12 may processed in any desired manner such as coating, slitting, and cutting into sheets, or the like.

Figure 2:
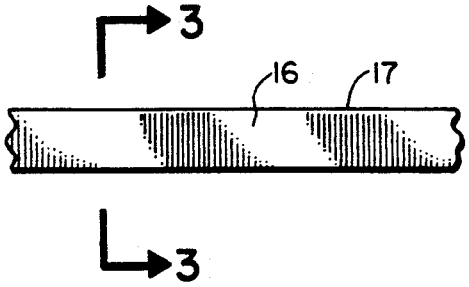
FIG. 2. PRIOR ART
FIG. 2 is an enlarged, front plan view of the curl bar of FIG. 1.
Figure 3:
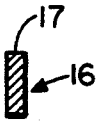
FIG. 3. PRIOR ART
FIG. 3 is a cross sectional view taken along lines 3—3 of FIG. 1.
Figure 4:
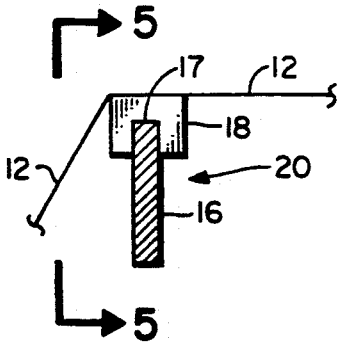
FIG. 4 is an end view of a first embodiment of the curl bar of the invention.
Figure 5:
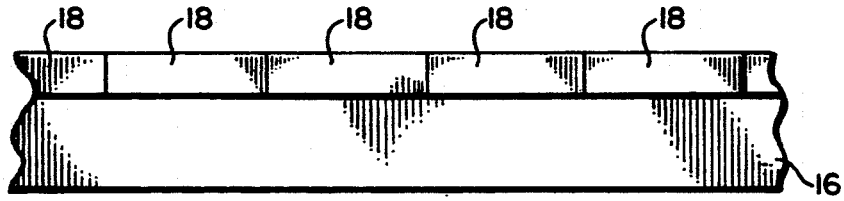
FIG. 5 is a plan view taken along lines 5—5 of FIG. 4.

As is known in the art, to remove the curl in the sheet 12, a curl removing bar generally indicated by the numeral 16 is located parallel to the axis of rotation of supply roll 10. Curl removing bar 16 is an enlogated, generally rectangular bar as shown in FIGS. 2 and 5 having a rectangular cross-section as shown in FIG. 3 and FIG. 4. Curl removing bar 16 is slightly longer than the width of supply roll 10 or sheet 12 so that the full width of the sheet 12 is contacted by the curl removing bar 16.

Curl removing bar 16 is commonly made of rigid metal such as steel and various alloys thereof. Curl removing bar 16 must be strong enough to resist the force of paper sheet or web 12. The top portion 17 of the bar 16 contact sheet 12 as sheet slides over curl removing bar 16 as shown in FIG. 1 causing the top portion 17 of curl removing bar 16 to wear away over a period of time due to the friction of sheet 12 sliding over the bar 16. Thus, in the devices of the prior art, curl removing bar 16 must be periodically replaced due to wear.

In FIGS. 4 and 5 is shown the first embodiment of the curl removing bar assembly of the present invention generally indicated by the numeral 20 which prevents wearing of the top portion 17 of the bar 16. Curl removing bar assembly 20 has a plurality of ceramic covers 18 which fit over the top portion 17 of the curl removing bar 16 and contact sheet 12 as shown in FIGS. 4 and 5.

The ceramic covers 18 have a much greater resistance to wear than the metal from which curl removing bars 16 are commonly made. The ceramic covers 18 are made from any strong, hard ceramic material known in the art, such as zirconia ceramic material.

A plurality of ceramic covers 18 are preferably utilized in constructing curl removing bar assembly 20 because the length of the bar 16 may be as long as six to twelve feet, or even longer. A one piece ceramic cover of such length cannot be made as cheaply as a plurality of smaller ceramic covers.

Figure 6:
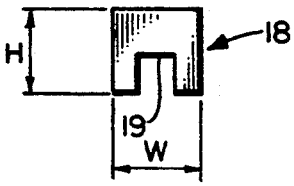
FIG. 6 is an enlarged elevational view of the end of the ceramic covers of the invention.
Figure 7:
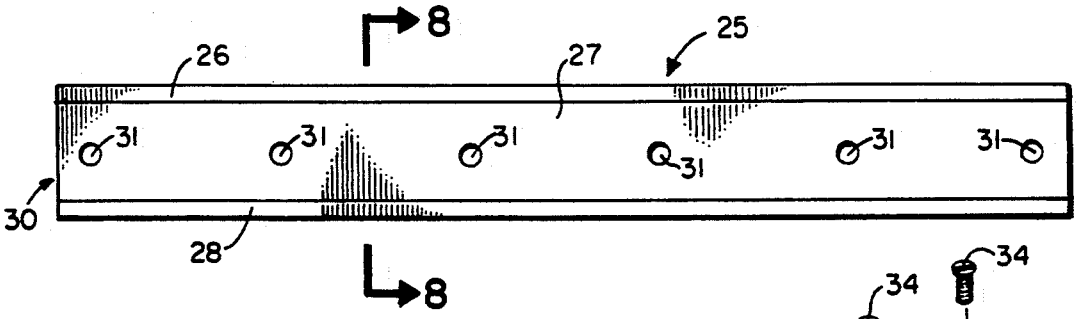
FIG. 7 is a top plan view of a second embodiment of a curl bar of the invention.

The ceramic covers of the invention preferably have a height H as shown in FIG. 6 of about 0.265 inches to about 0.235 inches. The width W of the ceramic covers 18 of the invention is preferably about 0.260 inches to about 0.250 inches.

As shown in FIG. 4, the ceramic covers 18 rest upon the top 17 of bar 16. If desired, the ceramic covers 18 could be fastened to the bar 16 by gluing, screwing, or by any other conventional method for bonding ceramic materials to metal.

Ceramic covers 18 utilized in constructing curl removing bar assembly 20 are preferably "U"-shaped in cross-section as shown in FIG. 4 and FIG. 6 with sharp corners terminating at right angles. However, if desired, the ceramic covers 18 could have curved or rounded corners.

A channel 19 in ceramic covers 18 is sized to receive the top portion 17 of curl removing bar 16. The channel 19 preferably is rectangular as shown in FIGS. 4 and 6; however, channel 19 may be shaped to fit the top portion of any curl removing bar upon which it is to be placed. Preferably channel 19 extends into ceramic cover 18 about one-half the height of ceramic cover 16.

After the ceramic covers 18 are placed upon the upper portion 17 of curl removing bar 16, the bar 16 having ceramic covers 18 thereon is returned to the position shown in FIGS. 1 and 4 with the top portion 17 of curl removing bar 16 oriented upward to place the ceramic covers 18 in contact with sheet 12.

Figure 8:
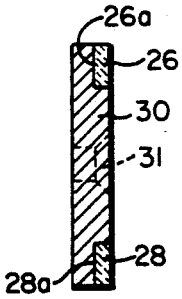
FIG. 8 is a cross-sectional view taken along lines 8—8 of FIG. 7.
Figure 9:
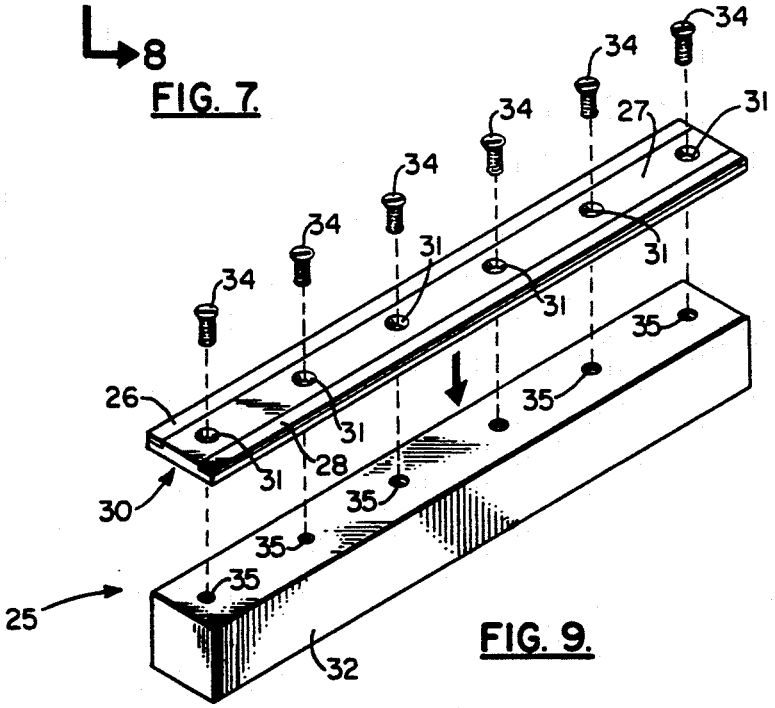
FIG. 9 is an exploded, perspective view of the curl bar shown in FIG. 7 and a curl bar holder.
Figure 10:
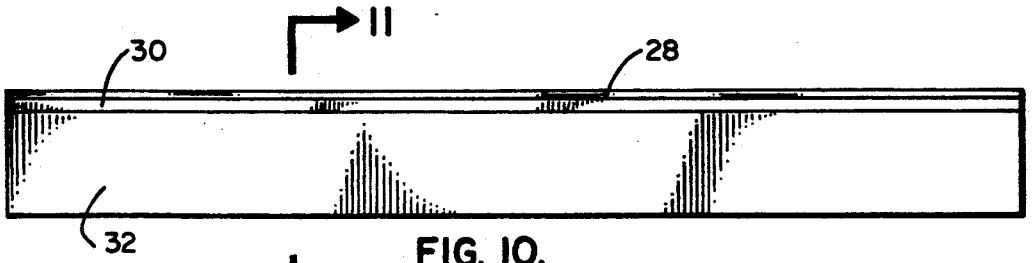
FIG. 10 is a side plan view of the curl bar of FIG. 7 attached to the curl bar holder.
Figure 11:
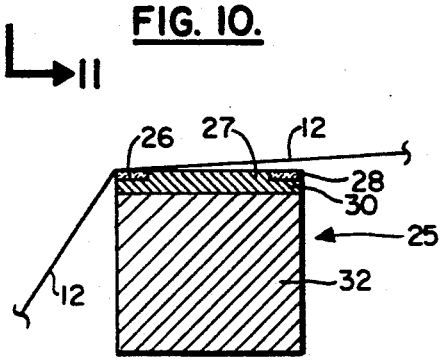
FIG. 11 is a cross-sectional view taken along lines 11—11 of FIG. 10.

In FIGS. 8 through 11 is shown the second embodiment of the curl removing bar assembly of the present invention generally indicated by the numeral 25. Curl removing bar assembly 25 includes preferably two elongated ceramic strips 26 and 28 connected to strip support bar 30 which contact moving paper sheet 12 as shown in FIG. 11. If desired, sheet 12 may form an angle with the top 27 of strip support bar 30 as shown in FIG. 11 after contacting ceramic strip 26 so that sheet 12 does not touch the top 27 of strip support bar 30. Ceramic strips 26 and 28 are rectangular in cross-section as shown in FIG. 8.

Ceramic strips 26 and 28 are rigidly fastened to notches 26*a* and 28*a* in strip support bar 30 by gluing, screwing, or any other method known in the art. Preferably, strip support bar 30 has a plurality of fastener receiving holes 31 therein. Elongated ceramic strips 26 and 28 are constructed from the same material as ceramic covers 18 are constructed.

Strip support bar 30 is rigidly connected to strip support bar carrier 32. Strip support bar carrier 32 is preferably rectangular in shape. Strip support bar 30 is preferably connected to strip support bar carrier 32 by screws 34—34 which are received in threaded holes 35—35 in strip support bar carrier 32.

When desired, curl removing assembly 25 may be rotated 180 degrees about its vertical axis from the position shown in FIG. 11 to cause the ceramic strip 28 to contact sheet 12. Or, if desired, strip support bar 30 may be removed from strip support bar carrier 32 and rotated 180 degrees about its vertical axis from the position shown in FIG. 11 to cause the ceramic strip 28 to contact sheet 12.

Figure 12:
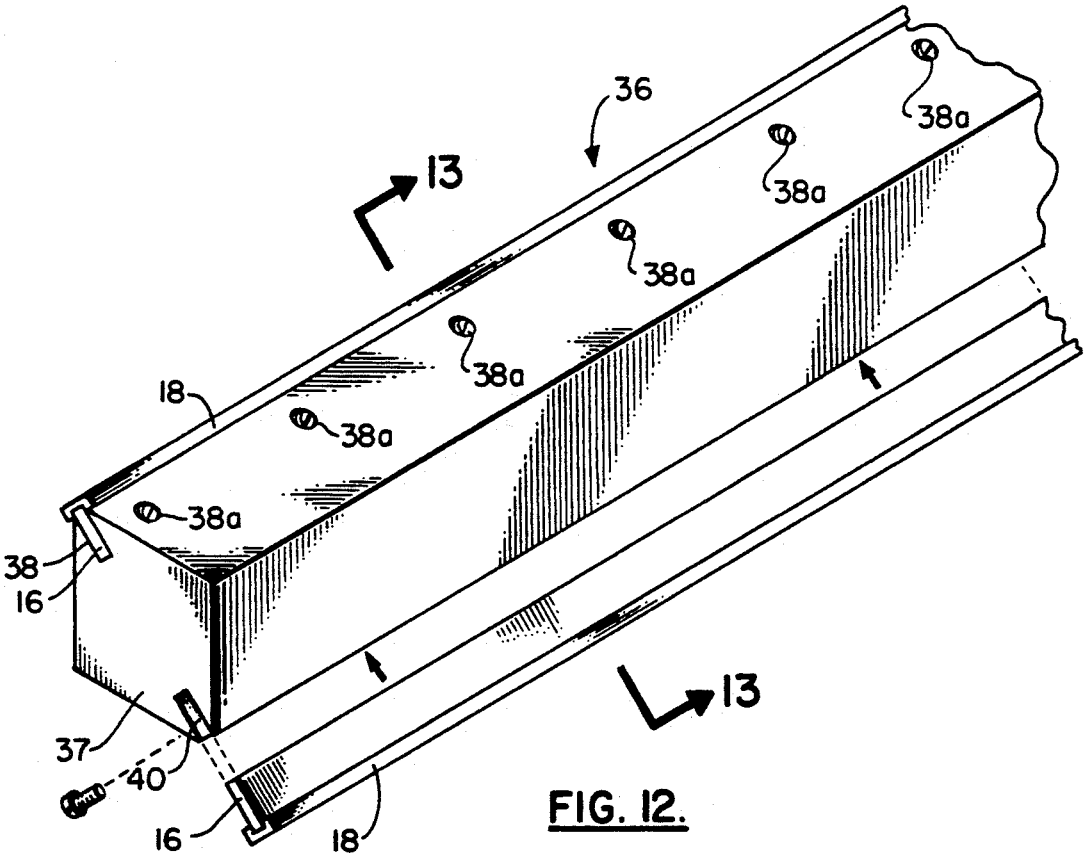
FIG. 12 is a partly exploded view of a third curl bar cover of the invention.
Figure 13:
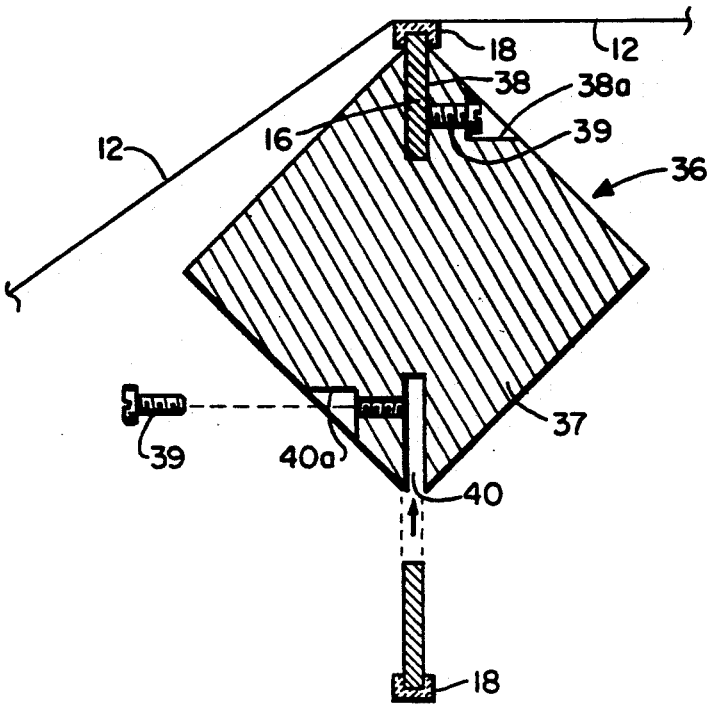
FIG. 13 is a cross-sectional view taken along lines 13—13 of FIG. 12.

In FIGS. 12 and 13 is shown a third embodiment of the curl removing bar assembly of the invention generally indicated by the numeral 36. Curl removing bar assembly 36 includes an elongated base 37 having a slot 38 or preferably slots 38 and 40 for receipt of bar 16 of curl bar assembly 20 shown in FIG. 4.

Elongated base 37 is preferably rectangular in cross-section as shown in FIG. 13. Located in elongated base 37 adjacent to slots 38 and 40 are a plurality of holes 38*a* and 40*a* for receipt of bolts 39. Bolts 39 are threaded into holes 38*a* and 40*a* to hold curl bar assembly 20 rigidly in slots 38 and 40.

As shown in FIG. 13, sheet 12 contacts ceramic cover 18 of one of the curl bar assemblies 20 attached to elongated base 37 to remove the curl from the sheet 12. When desired, elongated base 37 may be rotated 180 degrees about its longitudinal axis to cause the other curl bar assembly 20 mounted on elongated base 37 to contact sheet 12.

Although the preferred embodiments of the invention have been described in detail above, it should be understood that the invention is in no sense limited thereby, and its scope is to be determined by that of the following claims:

What is claimed is:

1. A curl removing bar assembly comprising, in combination:

a. an elongated steel curl removing bar for contacting a moving sheet to remove curl contained in said sheet, said elongated steel curl removing bar having a rectangular cross-section, said rectangular cross-section having two shorter sides and two longer sides, said two shorter sides defining a top edge and a bottom edge, said elongated steel curl removing bar being longer than the width of said sheet;

b. a plurality of U-shaped ceramic covers placed completely across said curl removing bar upon said top edge of said elongated steel curl removing bar for contacting said sheet material and preventing frictional wear of said elongated steel curl removing bar by said sheet material, each of said ceramic covers being generally rectangular in cross-section and having a rectangular channel therein for receiving said curl removing bar.

2. The curl removing bar assembly of claim 1 wherein said channel is about one-half the height of said ceramic cover.

3. The curl removing bar assembly of claim 2, wherein said ceramic cover have a height from about 0.265 inches to about 0.235 inches.

4. The curl removing bar assembly of claim 3 wherein said ceramic cover have a width from about 0.240 inches to about 0.250 inches.

5. The curl removing bar assembly of claim 4 wherein said ceramic cover are made from zirconia ceramic material.

6. The curl removing bar assembly of claim 1 wherein said curl removing bar is connected to an elongated base means for supporting said curl bar.

7. The curl removing bar assembly of claim 6 wherein at least two curl bars are connected to said elongated base means.

8. The curl removing bar assembly of claim 7 wherein said U-shaped ceramic covers are bonded to said elongated curl removing bar.

9. A curl removing bar assembly comprising an elongated rigid curl removing bar for contacting a moving sheet to remove curl contained in said sheet, said curl removing bar having a generally rectangular cross-section having four parallel edges, said curl removing bar having at least one recess adjacent to one of said edges and extending across the complete length of said curl removing bar, said recess having a rectangular cross-section adjacent to one edge thereof and an elongated ceramic strip having a rectangular cross-section fitted in said recess for contacting said sheet and preventing frictional wear of said curl removing bar by said sheet material.

10. The curl removing bar assembly of claim 9 wherein said curl removing bar is connected to curl removing bar carrier means for supporting said curl removing bar.

11. The curl removing bar assembly of claim 10 wherein said elongated ceramic strip is made from zirconia ceramic material.

* * * * *